US005660301A

United States Patent [19]

Kaplowitz

[11] Patent Number: 5,660,301

[45] Date of Patent: Aug. 26, 1997

[54] ATTACHMENT PROVISION FOR BOTTLE OR RECEPTACLE

[76] Inventor: Gary H. Kaplowitz, 8318 52nd St. Ct. W., University Place, Wash. 98467

[21] Appl. No.: 573,188

[22] Filed: Dec. 15, 1995

[51] Int. Cl.[6] ..... B65D 23/10

[52] U.S. Cl. ..... 220/771; 220/755; 215/398; 215/399

[58] Field of Search ..... 215/398, 399; 220/771, 755

[56] References Cited

U.S. PATENT DOCUMENTS

| | | | |
|---|---|---|---|
| D. 278,920 | 5/1985 | Wichman | D21/59 |
| 4,658,975 | 4/1987 | Cone | 215/398 |
| 4,925,042 | 5/1990 | Chong | 215/101 |
| 4,927,046 | 5/1990 | Armstrong | 220/736 |
| 4,969,571 | 11/1990 | Bartz | 220/771 |
| 5,139,666 | 8/1992 | Charbonneau et al. | 215/398 |
| 5,505,330 | 4/1996 | Nunes | 220/755 |

FOREIGN PATENT DOCUMENTS

| | | | |
|---|---|---|---|
| 457121 | 11/1991 | European Pat. Off. | 220/771 |
| 295736 | 10/1936 | Italy | 220/771 |
| 354710 | 5/1956 | Switzerland | 220/771 |

*Primary Examiner*—Stephen J. Castellano

[57] ABSTRACT

An attachment provision for a bottle or receptacle for use with various possible connecting devices currently available. In its preferred embodiment, the bottle/container attachment is comprised of a external recessed area (7) running across the bottle's/container's base. A hanging bar (8), formed integrally with this bottle/container, crosses the area (7) at the bottle's/container's medial plane (FIG. 3). The upper surface (8A) of bar (8), upper wall (11), transitioning radii (11A), (11B), (12A), and (12B) form a full radius slot (10) thus creating a connecting provision.

18 Claims, 3 Drawing Sheets

ATTACHMENT PROVISION FOR BOTTLE OR RECEPTACLE

BACKGROUND—FIELD OF INVENTION

This invention relates to bottles or other receptacles, particularly but not limited to infant or child feeding bottles.

BACKGROUND OF THE INVENTION

Many caregivers of infants and young children experience difficulty keeping the child's feeding bottle in close proximity to the child. The bottles are often dropped, thrown out of strollers, high chairs, or infant car seats by the child and are either lost, found under car adult passenger seats with curdled milk or fermented juice or must be handed back to baby time and again. This adult intervention is often not possible if the feeding child is located in a back seat and where the caregiver (being the only other occupant) is driving. This situation is tedious regardless of where it occurs and whether or not intervention is possible. Several connecting devices have been developed to keep various infant articles such as pacifiers and toys in the proximity of young children.

In the broad field of infant article connecting devices, a variety of Copyrights and/or Patents have been filed. One variety is a pacifier Holder (© 1993 Baby Buddy's ) which comprises of a polyester fabric strap that folds over and snaps closed (for pacifier attachment.) The other end has an alligator type clip (for connection to the child's clothing.) Another variety of pacifier holder (© 1988 & 1993 Safety 1st) is essentially the same as above except that a hook and loop type closure is used instead of a snap for pacifier attachment. U.S. Pat. No. Des. 278,920 to William J. Wichman (1982) led to the production of the multi-colored plastic toy chain links which clip together in series for suspending various ringed toys (e.g., plastic keys on a ring, pacifiers and other infant use items). A toy or pacifier retention strap called an "Attach -A-Toy" (© 1993, Kiddie Products, Avon, Mass.) is also available. This item, which is comprised of a nylon strap, folds over and snaps closed on each end. It is important to note that although none of the above connecting devices is currently marketed for baby bottle retention, they could be. However, no feeding bottle in the current prior art provides an attachment provision that results in enough effective length for successful broad application with the aforementioned connecting devices. Of these connecting devices, only the links would provide adequate length for bottle attachment use and they provide no means of attachment to a feeding bottle in the current prior art. In the more specific field of child feeding bottle retention, a few products have been produced.

Attempts to provide baby bottle retention have resulted in the manufacture of a feeding bottle attachment ring provision called an "Attach-A-Bottle" (© 1988, Safety 1st, Inc., Chestnut Hill, Mass.),. This product comprises of a plastic ring that receives the upper neck of a feeding bottle. The plastic ring is retained by the bottle's lid. This plastic ring contains a slot which receives a woven nylon strap which folds over and snaps closed. It has a similar fold over snap closure on the opposite end of the nylon strap for attachment to strollers, high chairs, car seats, etc. While this invention offers a means of retaining the bottle close to the child, the bottle attachment point on the bottle's neck poses an entanglement potential. Specifically, the nylon strap is awkwardly located between the child and their gripping location on the bottle. When the bottle is dropped or thrown and re-grasping is attempted by the child, the strap gets tangled in the child's hands. The child is hindered from resuming feeding and adult intervention is sometimes required. Another disadvantage of the "Attach-A-Bottle" is that it, like the aforementioned infant article retention devices, it does not provide adequate length for use in some applications (e.g.—with some car seats) for the following reason. Current ASTM guidelines (Ref. ASTM 963, section 4.13.1) indicate that the maximum length for "flexible strings or chords attached to any toy shall be less than 12" (300 mm) when measured to the maximum length in the free state." The "Attach-A-Bottle" strap, which apparently complies to this guideline, having a 12" length, is too short for use with many car seats. The primary cause for this inadequate length is due to the bottle attachment location being near the top of the bottle. My "Attachment Provision for Bottle or Receptacle" shows how that a strap complying with the above ASTM guidelines succeeds in providing adequate length where the "Attach-A-Bottle" fails. The implications of bottle attachment location upon effective length and the resulting usefulness in broader application is elaborated below (Ref. item "e" in the Objects and Advantages portion, of the present invention.)

U.S. Pat. HO. 4,925,042 to Ray Chong (1988), "The Independent Infant Bottle Feeding Ensemble", shows a "coil spring (dothes pin)—type damp" which holds the bottle in place for self feeding. While this invention successfully keeps the bottle in close proximity to the child, it limits the types of items which could be clamped to those which are flat or soft enough to be introduced into the clamp. Specifically, the carrying handles of portable car seats and the frame of strollers would not fit into this clamp. This feeding ensemble's clamp also has limited attachment options. It does not allow for combined use with many connecting devices. For example, the plastic links previously mentioned do not fit due to the small orifice provided between the damp 15 and its base 17. (See FIG. 1 of U.S. Pat. No. 4,925,042.) In the event where such a compatible connecting device might be used, this clamp still poses a potential entanglement concern because the clipping location is on the child's gripping surface.

The "PODEE" brand "Hands Free Baby Bottle" is a self feeding system with a plastic straw-like extension from the bottle to a remote nipple. This item also provides the benefit of bottle retention. It is designed to be attached to a car seat or other location by means of a "hook strap." This hook strap is a hook and loop closure on a nylon strap that straps the bottle to the car seat or other medium. This self feeding hands free system, while preventing bottle loss and seeming to have less entanglement potential, is prohibitively expensive, listing at almost $8 for the system. This nearly twice the current cost of the high end conventional bottles available in the current market. It is a more complex system to use and the plastic straw is difficult to wash.

OBJECTS AND ADVANTAGES

A preferred practical application for my attachment provision is for attaching child feeding bottles to car seats, strollers and high chairs to prevent loss and to allow resumed feeding by the child without adult intervention. The present invention in its preferred embodiment is a child feeding bottle which successfully overcomes the foregoing disadvantages of the prior art by means of the following benefits;

(a) an attachable bottle that provides retention of the bottle near the child;

(b) an attachable bottle that that prevents entanglement. Once dropped, the resulting orientation of the bottle and its connection device is a linear one that allows ease of re-grasping the bottle for resumed feeding by the child. Once the child has the bottle in hand, the connection device's attachment point is beyond the child's gripping location being located on the bottle's base surface;

(c) an attachable bottle whose entanglement prevention eliminates the need for adult intervention making it preferable to the aforementioned "Attach-A-Bottle";

(d) an attachable bottle that has exceptional compatibility with the vast array of potential connecting devices currently available thus enhancing the flexibility of connecting device options thus being preferable to the aforementioned feeding ensemble of U.S. Pat. No. 4,925,042;

(e) an attachable feeding bottle that has enough effective length for practicable, safe application when used with connecting devices which comply with the aforementioned ASTM 963's 12" limit. This additional effective length is accomplished by means of the attachment point being located on the bottle's base, thus effectively adding the bottle's length to this 12" limitation. This makes my attachment feature as applied in this embodiment preferable to the aforementioned "Attach-A-Bottle".

(f) an attachable bottle whose attachment provision is in a recessed location thus making it less susceptible to impact damage than the aforementioned spring clamp of U.S. Pat. No. 4,925,042;

(g) an attachable bottle that has a external recessed area 7 designed to allow for even wall thickness formation in this region during a plastic blow mold process (the area's shallow depth, narrow width and large transitioning radii 12A, 12B, 13A and 13C allow for this—See FIG. 4);

(h) an attachable bottle whose same area 7 design makes it easy to clean and is thus preferable to the plastic straw of the aforementioned PODEE system;

(i) an attachable bottle whose cost is comparable to other feeding bottles available and thus preferable to the aforementioned PODEE system;

(j) an attachable bottle that can be hung to dry after washing in an inverted position on tea cup hooks;

(k) an attachable bottle that can be stored efficiently and marketed intriguingly in an inverted position;

(l) an attachable bottle that affords an alternate means of removing, sterilized bottles from boiling water using the attachment provision;

(m) an attachable bottle whose external recessed area 7 allows for a simple, economical two part injection blow form mold design, the parting plane thereof being common to the section 4—4 taken in FIG. 3;

(n) an attachable bottle whose bridging media's (i.e.—bar 8's or other's) lower surface 8B is located above the base surface 9A and 9B, thus allowing the bottle to be supported on its base for storage and/or filling.

Further ramifications of this attachment provision and uses for other embodiments such as jars, vials or other storage receptacles, being in addition to the above advantages, are as follows:

(o) an attachable receptacle that offers an alternate labeling method. This attachable receptacle is not limited to the conventional labeling methods of adhesive or gum label application to the external surface. String or wire tags may now be used with the attachment provision eliminating the presently difficult re-labeling task of removing existing gum or adhesive labels. Label changing is as easy as replacing an old tag with a new one.

(p) a receptacle that can be retained by machinery in an automated production or processing environment by this attachment provision;

(q) a receptacle that has a preferable attachment location for sanitary, biological hazard, chemical hazard, radiological hazards, criminal evidence, or other sample storage applications as the attachment location is located furthest from the receptacle's opening This prevents potential contamination of the specimen, or criminal evidence and harmful exposure to the specimen handler of biological, radiological or chemical hazards.

(r) an attachment provision for bottle or receptacles that may be formed integrally or monolithically with the body of the bottle or receptacle thus reducing manufacturing costs and eliminating complex assembly.

DESCRIPTION OF INVENTION

Figure 1:
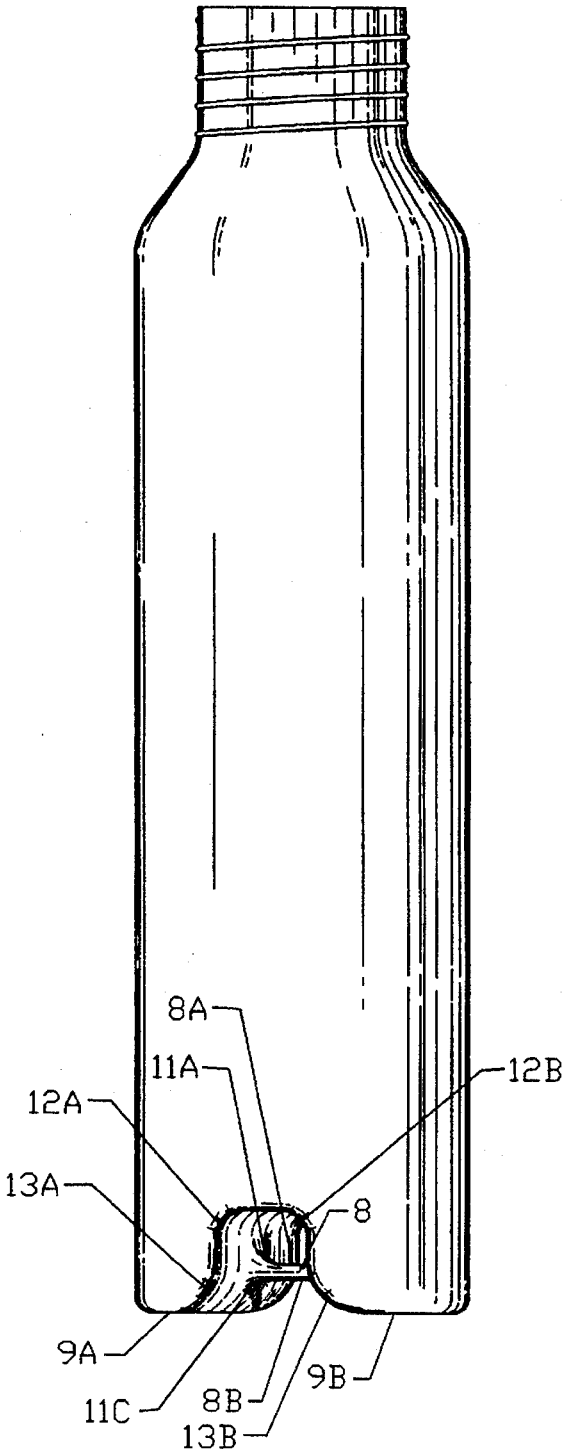
FIG. 1 is a perspective, elevation view of a feeding bottle for use by infants or small children.
Figure 2:
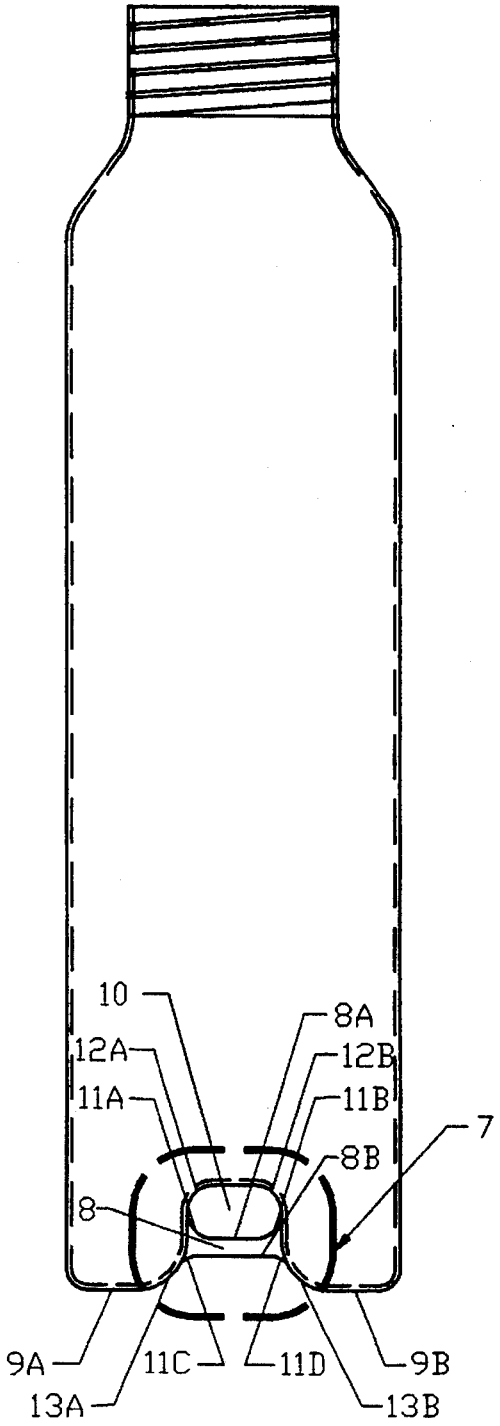
FIG. 2 is a front elevation view thereof.
Figure 3:
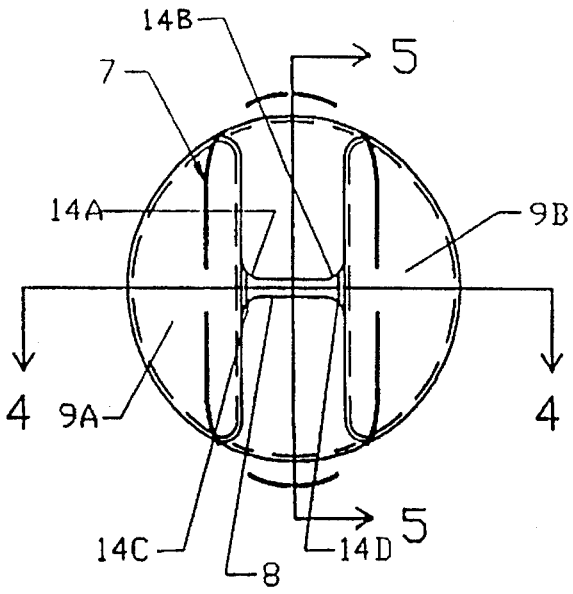
FIG. 3 is a view of the bottom of FIG. 2 thereof.
Figure 4:
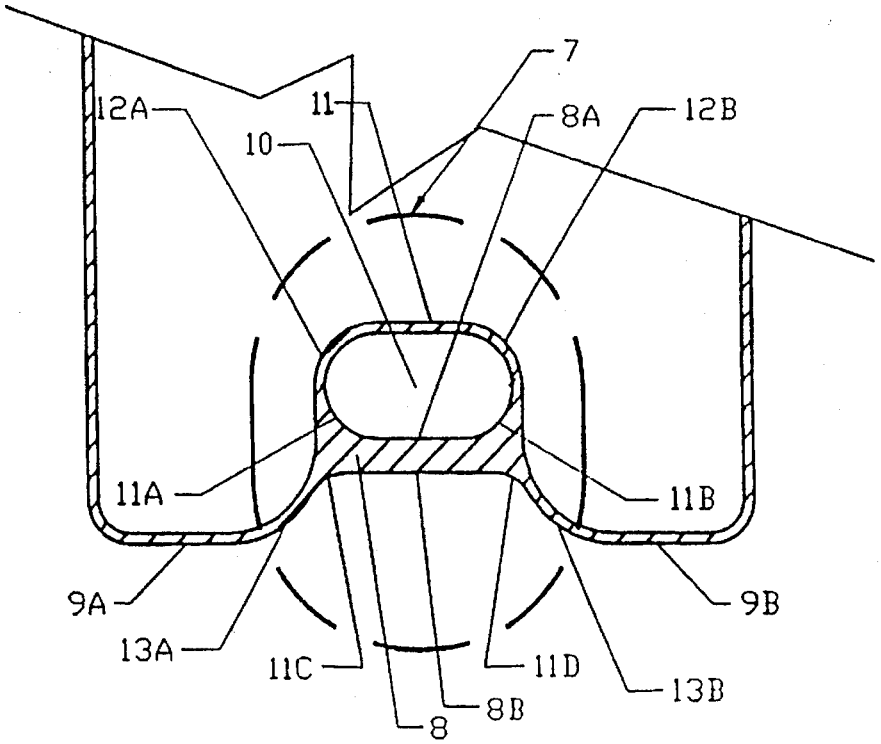
FIG. 4 is an enlarged section view of the bottle's base taken perpendicular to the external recessed areas 7's longitudinal axis, the section having been taken along section 4—4 in FIG. 3.
Figure 5:
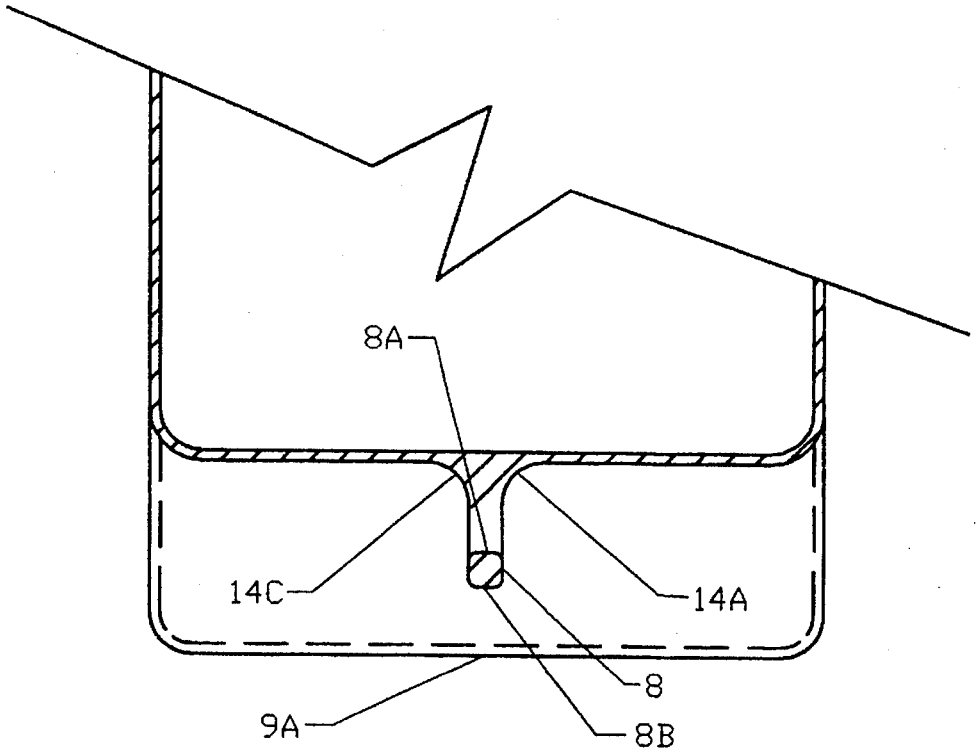
FIG. 5 is an enlarged section view of the bottle's base taken perpendicular to a hanging bar 8, the section having been taken along section 5—5 in FIG. 3.
Figure 6:
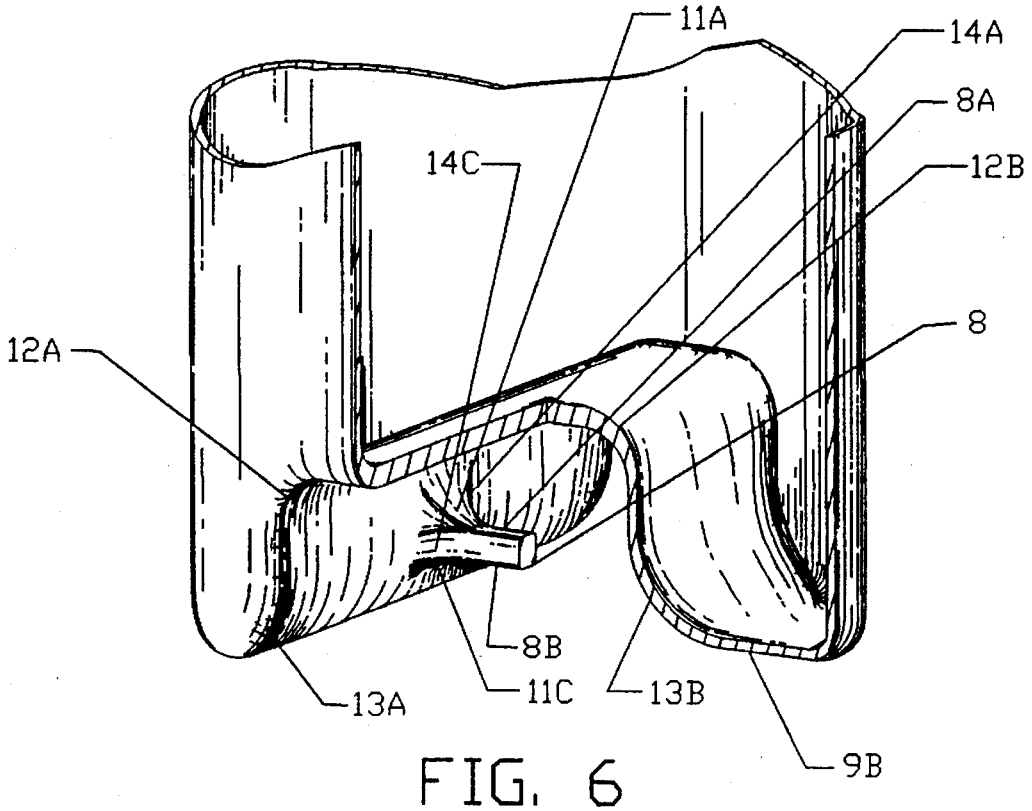
FIG. 6 is an enlarged perspective view of the bottles base with a portion of the bottle being cut away to clarify the drawing and facilitate consideration and discussion.

Although the present invention has utility as a bottle or receptacle having many different and diverse end uses, it is especially suited as a feeding bottle for small children. Referring to FIGS. 2 through 6, FIG. 2 shows an elevation view of the present invention in its preferred embodiment, i.e. a child feeding bottle which provides an integral connection provision on the bottle itself. This connection provision is located in a external recessed area 7 in the bottle's base. Area 7 comprises of a hanging bar 8 (which has an upper surface 8A and a lower surface 8B), and transitioning radii 11A, 11B, 12A, 12B, 13A, and 13B. Bar 8 forms a full radius slot 10 by means of surface 8A, and radii 11A, 11B, 12A, and 12B. Bar 8 is formed integrally with the bottle and is connected to the external side walls of area 7 by means of radii 11A, 11B, 11C, 11D and transitional radii 14A, 14B, 14C & 14D which are shown in FIG. 3. Bar 8 crosses at the roedial section of area 7. The surface 8B is located above the bottles supporting base surfaces 9A and 9B, thus allowing the bottle to be supported for filling or storage and preventing possible impact damage. FIG. 3 shows the bottom surface of the bottle showing area 7, bar 8, base 9A, 9B and radii 14A, 14B, 14C, and 14D. FIG. 4 shows an enlarged section of the bottle's base taken along section 4—4 in FIG. 3. FIG. 4 shows area 7, bar 8, base 9A and 9B, slot 10, radii 11A 11B, 11C, 11D, 12A, 12B, 13A and, 13B. FIG. 5 is an enlarged section showing the bottle's base taken along 5—5 in FIG. 3. FIG. 5 shows bar 8 with its upper surface 8A and lower surface 8B, and radii 14A and 14C. FIG. 6 is an enlarged perspective view of the bottle's base, with a portion cut away for clarity. FIG. 6 shows bar 8 with surfaces 8A and 8B, base surface 9A and 9B, and transitioning radii 11A, 12A, 12B, 13A, 13B, 14A, and 14C. It is to be understood that the form of the invention herein shown and described is to be taken as a preferred example of the same, and that various changes in the shape, size, materials and arrangements of parts may be resorted to without departing from the spirit of the invention or scope of the appended claims. Many other variations are possible. For example an annular ring could be formed rather than a full radius slot, the slot or other orifice could be located in a solid rectangular septum of sufficient thickness that crosses the recessed area. Further, the bottle could be a short receptacle made from glass, metal or plastic with a non-threaded closure and a non tapered neck. Accordingly, the scope of the invention should be determined not by the embodiment illustrated, but by the appended claims and their legal equivalents.

I claim:

1. An attachment provision for bottle or receptacle for use with a connection device comprising;

a) a recessed surface provided in the base surface of a receptacle;

b) said recessed surface being of sufficient depth to accommodate a bridging media, said bridging media, having an upper surface and a lower surface, crosses said recessed surface;

b) said lower surface being located above said base surface;

c) said recessed surface and said upper surface form a hole of predetermined size and shape to accommodate a connection device.

2. The attachment provision of claim 1 wherein said bridging media is a polygonal septum of predetermined size, shape and thickness.

3. The attachment provision of claim 1 wherein said hole is of sufficient size to accommodate means for storing said receptacle in an inverted position.

4. The attachment provision of claim 1 wherein said bottle or receptacle is composed of blow form-able plastic.

5. The attachment provision of claim 1 wherein said attachable bottle or receptacle is cast in glass.

6. The attachment provision of claim 1 wherein said bottle or receptacle is made of metal.

7. The attachment provision of claim 1 wherein said connection device is part of an automated piece of machinery.

8. The attachment provision of claim 1 wherein said bottle or receptacle's size and composition is suitable for storing chemically hazardous substances.

9. The attachment provision of claim 1 wherein said bottle or receptacle's size and composition is suitable for storing radio-active substances.

10. The attachment provision of claim 1 wherein said bottle or receptacle's size and composition is suitable for storing biologically hazardous substances.

11. The attachment provision of claim 1 wherein said bottle or receptacle's size and composition is suitable for storing criminal evidence.

12. An attachable child feeding bottle for use with a connection device comprising;

a) a recessed surface provided in the base surface of a receptacle;

b) said recessed surface being of sufficient depth to accommodate a bridging media, said bridging media, having an upper surface and a lower surface, crosses said recessed surface;

b) said lower surface being located above said base surface;

c) said recessed surface and said upper surface form a hole of predetermined size and shape to accommodate said connection device.

13. The bottle of claim 12 wherein said bridging media is a polygonal septurn of predetermined size, shape and thickness.

14. The bottle of claim 12 wherein said hole is of sufficient size to accommodate means for storing said receptacle in an inverted position.

15. The bottle of claim 12 wherein said bottle or receptacle is composed of blow form-able plastic.

16. The bottle of claim 12 wherein said attachable bottle or receptacle is cast in glass.

17. The bottle of claim 13 wherein said bottle or receptacle is made of metal.

18. An attachable bottle or receptacle for use with a connection device comprising;

a) a recessed surface provided in the base surface of a receptacle;

b) said recessed surface being of sufficient depth to accommodate a bridging media, said bridging media, having an upper surface and a lower surface, crosses said recessed surface;

b) said lower surface being located above said base surface;

c) said recessed surface and said upper surface form a hole of predetermined size and shape to accommodate said connection device.

* * * * *